United States Patent [19]

Rennison et al.

[11] 4,131,468

[45] Dec. 26, 1978

[54] DIAZOTYPE MATERIALS

[75] Inventors: Stuart C. Rennison, Hadleigh; John A. Pope, Colchester; Timothy D. Andrews, East Bergholt, near Colchester, all of England

[73] Assignee: Imperial Chemical Industries Limited, London, England

[21] Appl. No.: 542,021

[22] Filed: Jan. 17, 1975

[30] Foreign Application Priority Data

Jan. 25, 1974 [GB] United Kingdom ..... 3591/74

[51] Int. Cl.[2] ..... G03C 1/52; G03C 3/02

[52] U.S. Cl. ..... 96/75; 96/76 R

[58] Field of Search ..... 96/75, 78 R

[56] References Cited

U.S. PATENT DOCUMENTS

| | | | |
|---|---|---|---|
| 2,873,207 | 2/1959 | Weegar et al. | 96/75 X |
| 3,027,256 | 3/1962 | Klimkowski et al. | 96/75 X |
| 3,301,679 | 1/1967 | Halperin et al. | 96/75 |
| 3,536,490 | 10/1970 | Hochberg | 96/75 X |
| 3,679,419 | 7/1972 | Gillick | 96/75 X |
| 3,704,124 | 11/1972 | Conant | 96/75 X |

FOREIGN PATENT DOCUMENTS

| | | | |
|---|---|---|---|
| 852148 | 9/1970 | Canada | 96/75 |
| 1169227 | 10/1969 | United Kingdom | 96/75 |

*Primary Examiner*—Thomas J. Herbert, Jr.
*Attorney, Agent, or Firm*—Cushman, Darby & Cushman

[57] ABSTRACT

Modifying the surface of a diazotype material by incorporating an acrylic or methacrylic polymer into the diazotype sensitizing coating composition or coating the assembly with it so as to roughen the surface of the material thereby enabling nitrogen, which is liberated when the material is exposed to light, to escape from between the master and the diazotype material to prevent nitrogen accumulating between the two and hence avoiding slippage of one relative to the other.

7 Claims, 4 Drawing Figures

DIAZOTYPE MATERIALS

Figure 1:
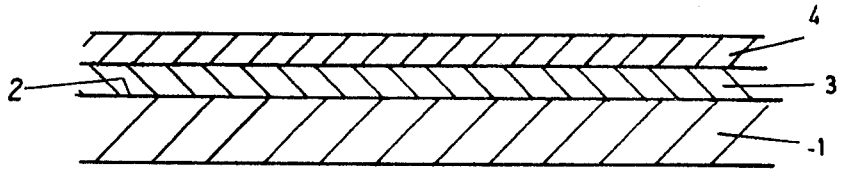

This invention relates to diazotype film materials and their production.

Diazotype materials generally consist of a support carrying a light sensitive diazonium compound. When such materials are exposed to a light image, especially ultra-violet light, the undecomposed diazonium compound may subsequently be converted into an azo dye thereby providing a recorded image. The conversion to the azo dye is effected by reaction with a coupling agent which may be a phenolic or active methylene compound. The coupler may be employed in a number of ways: by incorporating it into the diazotype coating and developing it by treatment with an alkali; by including an alkali as well as the coupler in the diazotype coating but inhibiting the alkali and thermally activating it to effect coupling; or by treating the exposed diazotype material with a processing solution containing the coupler.

Generally diazotype materials are made by applying a solution of a diazonium compound which usually contains other materials such as couplers and optionally a resinous binder to a support. When the support is a plastics film intermediate anchoring layers may be applied to the film surface.

The copying process may be effected by feeding a master and the diazotype material in intimate contact around the periphery of a rotating drum, glass cylinder or through a vacuum head, during exposure to UV light. The diazotype material is thereby exposed through the master. It has been found that in certain high speed printing machines the image produced on the diazotype material is often of poor resolution and frequently shows multiple images. This defect appears to arise because of "slippage" between the master and the diazotype material. The term "slippage" is not used in the conventional sense of one surface sliding over another, which would produce blurred images, but to describe a random movement of the master and/or diazotype material which results in the formation of multiple images. Slippage as thus defined is probably not governed by the frictional characteristics of the abutting surfaces but by the evolution of nitrogen from the diazonium compound when it is decomposed by light. In high speed printing machines nitrogen is probably evolved faster than it can escape from between the contacting surfaces of the master and diazotype material and therefore collects between the surfaces thus reducing their intimate contact and producing multiple images.

It has now been found that the incorporation of certain polymeric materials into the coating compositions applied to diazotype assemblies or the application of the polymeric materials as coatings to certain layers of the diazotype assembly serves to minimise "slippage" and hence the risk of multiple image formation.

According to this invention a process for the production of a diazotype material comprises sensitising a layer applied to a support film with a light sensitive diazonium compound wherein an anti-slip material comprising a homopolymer or copolymer of acrylic acid or methacrylic acid or a lower alkyl ester of acrylic acid or methacrylic acid in which the alkyl group contains up to 8 carbon atoms is applied to the diazotype material, said antislip material comprising from 0.3 to 10.0% by weight of the solution or dispersion from which it is applied. The invention also relates to diazotype materials made by such a process.

In one aspect of the invention, the support film is coated with a composition which includes the light sensitive diazonium compound, and either (a) said composition also contains a resinous binder and is applied directly to the surface of the support film or to an underlying subbing layer or (b) the composition is applied to a receptive plastics layer, wherein the anti-slip material is (1) also incorporated into the composition containing the diazonium compound and the resinous binder, the resinous binder and anti-slip material representing up to 30% by weight of the solid ingredients of the composition, (2) incorporated into the receptive plastics layer, (3) incorporated into the diazonium composition applied to the receptive plastics layer or (4) applied as a direct coating layer to the receptive plastics layer or to the surface of the layer containing the resinous binder and the diazonium compound.

Throughout this specification the proportions of the ingredients of the coating compositions are stated as percentages by weight of the appropriate ingredient in grams per 100 ml of an inert medium from which the composition is applied. The inert medium can be water or an organic solvent which has no adverse chemical or physical action upon the support film, the light sensitive diazonium compound and the anti-slip material.

The invention also relates to a diazotype material which comprises a support film coated with a layer which comprises a light sensitive diazonium compound, said material including a coating comprising a homopolymer or copolymer of acrylic acid or methacrylic acid or a lower alkyl ester of acrylic acid or methacrylic acid in which the alkyl group contains up to 8 carbon atoms as an anti-slip material, said anti-slip material being present in an amount of 0.75 to 25.0 mg/dm$^2$ of the film surface.

According to another aspect of the invention the support film coated with a layer which includes a light sensitive diazonium compound, and either (a) said layer also contains a resinous binder and is applied directly to the surface of the support film or to an underlying subbing layer or (b) said layer comprises a receptive plastics material impregnated with the diazonium compound, wherein the anti-slip material is (1) also incorporated into the layer containing the diazonium compound and the resinous binder, the resinous binder and anti-slip material representing up to 30% by weight of the solid ingredients of the layer, (2) included in the receptive plastics material, (3) is applied to the layer containing the receptive plastics material or the resinous binder, said anti-slip material being present in an amount of 0.75 to 25.0 mg/dm$^2$ of the film surface.

The support film may consist of any suitable plastics film such as films of cellulose esters, e.g. cellulose acetate, polystyrene, polyesters of dibasic aromatic carboxylic acids with divalent alcohols, e.g. polyethylene terephthalate, polyamides, polymers and copolymers of vinyl chloride, polycarbonate and polymers and copolymers of olefines, e.g. polypropylene. Support films made from these materials may be produced by any process known in the art. In particular films of some of these materials may be made by stretching the films in one or more directions to impart molecular orientation followed by heat setting to prevent the stretched films shrinking when they are subjected to high temperatures. Such a stretching and heat setting process may be used for the production of biaxially oriented and heat set films of polyethylene terephthalate. The preferred films for use according to this invention are films of cellulose acetate and biaxially oriented and heat set films of polyethylene terephthalate.

The surface of the support film may be treated to enhance the adhesion of the subsequently applied layers, and for this purpose treatments known in the art may be employed. For instance when the support film is a biaxially oriented and heat set film of polyethylene terephthalate it may be treated with a priming agent, or a solution of a priming agent, which has a solvent or swelling action upon the film surface, such as halogenated phenolic materials, e.g. orthochlorophenol, parachlorophenol and 4-chloro-3-methylphenol, chloral hydrate and halogenated acids, e.g. trichloracetic acid.

The support film may also carry one or more subbing layers which may be applied to develop adhesion between the film surface and the subsequently applied layers, such as a receptive plastics layer or a layer containing the diazonium compound and a resinous binder or a viscosity modifier. The subbing layer applied directly to the surface of the support film is termed an anchor layer herein. Any suitable polymeric or copolymeric material may be used in a subbing layer, including anchor layers. Copolymers of vinylidene chloride with comonomers such as acrylonitrile are useful ingredients for subbing layers, as are those polymers and copolymers described and claimed in British specifications Nos. 1 088 096, 1 141 395, 1 143 843, 1 177 426, 1 178 597 and 1 208 821, i.e. vinyl halogenoester and vinyl cyanoester homopolymers or copolymers with one or more other materials such as $\alpha$, $\beta$-unsaturated carboxylic acids, acrylamide and methacrylamide and their N-methylol derivatives, vinyl acetate and vinyl alcohol. Useful subbing materials are copolymers of vinyl monochloroacetate with vinyl alcohol. Other useful subbing materials are copolymers of vinyl chloride and vinyl acetate which may be partially hydrolysed, cellulose nitrate or cellulose acetate butyrate and phenol formaldehyde, urea formaldehyde or melamine formaldehyde resins.

Of the many light sensitive diazonium compounds suitable in diazotype copying, those derived from the amines listed below are typical and may be employed in this invention:

N,N-dimethyl-p-phenylenediamine
N,N-diethyl-p-phenylenediamine
N,N-dipropyl-p-phenylenediamine
N-ethyl-N-$\beta$-hydroxyethyl-p-phenylenediamine
N,N-dibenzyl-3-ethoxy-4p-phenylenediamine
4-N-morpholino-aniline
2,5-diethoxy-4-N-morpholino-aniline
2,5-dimethoxy-4-N-morpholino-aniline
2,5-di-(n-butoxy)-4-N-morpholino-aniline
4-N-pyrrolidino-aniline
3-methyl-4-N-pyrrolidino-aniline
3-methoxy-4-N-pyrrolidino-aniline
2-ethoxy-4-N,N-diethylamino-aniline
2,5-diethoxy-4-benzoylamino-aniline
2,5-diethoxy-4-thio(4'-tolyl)-aniline Other suitable known diazonium salts may be employed if desired.

These diazonium compounds may be in the form of the zinc chloride double salt, the cadmium chloride double salt, the chloro-benzene-sulphonate, the borofluoride and the like when used in the process of this invention.

The light sensitive diazonium compounds may be applied to the film support from conventional aqueous or organic based compositions which may include coupling agents of the type generally employed in the manufacture of light sensitive diazotype materials. These coupling agents may be those containing a phenolic hydroxy group or an active methylene group. Examples of such substances are:

resorcinol
4-methyl-resorcinol
4-n-hexyl-resorcinol
1,3-dihydroxy-4-chlorobenzene
phloroglucinol
acetoacetanilide
acetoacet-o-toluidide
m-hydroxy-acetoacetanilide
2,2',4,4'-tetrahydroxy-diphenyl
2,2',4,4'-tetrahydroxy-diphenyl sulphide
m-hydroxy phenyl-urea
2,3-naphthalene-diol
2-hydroxy-2'-methyl-3naphthanilide
2-hydroxy-2'-methoxy-3-naphthanilide
cyanacet morpholide
3-methyl-1-phenyl-5-pyrazolone Other suitable known coupling agents may be employed if desired. If a coupling agent is not included in the coating composition applied to the support film, the film may be developed with a processing solution which includes a coupling agent.

The light sensitive layers may also include conventional acid stabilisers to inhibit premature coupling, e.g. citric acid, tartaric acid sulphosalicyclic acid, p-toluenesulphonic acid or other inorganic, aliphatic or aromatic acids.

In addition to the foregoing ingredients the diazonium compound containing sensitising composition may also optionally contain the various additives conventionally employed in the manufacture of light sensitive diazotype materials including hygroscopic agents, e.g. ethylene glycol, propylene glycol; further stabilising or antioxidising agents such as thiourea, which function to retard the development of background colouration on the finished print; metallic salts for intensification of the dyestuffs image, e.g. zinc chloride, nickel sulphate; wetting agents, e.g. saponin, lauryl sulphonate, the oleic acid amide of N-methyl taurine; fillers, opacifying and toothing agents, e.g. finely divided silica or glass powder, to enable the finished material to be written upon.

The diazonium compound may generally be employed in an amount from 1 to 15%, preferably 2 to 5% by weight of the aqueous or organic composition from which it is applied. The diazonium compound coating or treating composition may optionally include a resinous binder which may be any of those materials known to be suitable for the purpose. Resinous binders of particular use are cellulose acetate, cellulose acetate propionate, cellulose acetate butyrate, polyvinylacetal, polyvinyl acetate, and partially hydrolysed polyvinyl acetate. The resinous binder may be included in the diazonium compound containing sensitising composition in an amount ranging from 5 to 30% by weight, preferably 5 to 15% by weight so that the finished dried diazotype material has a coated layer in which the thickness of the layer containing the resinous binder is 3 to 30$\mu$, preferably 5 to 20μ. Such a layer containing a resinous binder may be applied direct to the surface of the support film, which may have been pretreated with a priming agent or to the surface of a subbing layer which has been applied to the film.

According to this invention the diazotype assembly may carry a receptive plastics layer which may be treated with a sensitising solution containing the diazonium compound, which may include small amounts of a viscosity modifying resin similar to the binders listed above. The viscosity modifying resin may be included in the sensitising solution in an amount ranging from 0.1 to 5%, preferably 0.5 to 2% by weight. The treatment of the receptive layer may result in the deposition of a coating upon the layer, but more normally in the impregnation of the layer by the sensitising solution. The receptive layer should therefore be susceptible to surface coating with a layer of the sensitising composition or be capable of being impregnated with the sensitising solution preferably the latter. Receptive layers which may be sensitised by impregnation with a sensitising composition may include plastics materials which are already known for the purpose, e.g. cellulose acetate, cellulose acetate propionate, cellulose acetate butyrate, polyvinylacetal, polyvinyl acetate or partially hydrolysed polyvinyl acetate.

The anti-slip material employed according to this invention is preferably polymethyl methacrylate, polyethyl methacrylate, polybutyl methacrylate, polymethyl acrylate, polyethyl acrylate, a copolymer of butyl methacrylate and methyl methacrylate or a mixture of two or more of these materials, and especially polymethyl methacrylate or a mixture of 75% by weight polymethyl methacrylate with 25% by weight polyethyl methacrylate.

According to the invention the acrylic or methacrylic material is applied to the diazotype material as an anti-slip agent. It has been found that such materials produce a surface roughness upon the diazotype material, which has a "crazed" or "reticulated" appearance, and this is thought to provide channels along which the nitrogen can escape when the material is exposed to actinic light through a master. As a result serious accumulations of nitrogen between the diazotype material and the master are avoided thereby reducing the risk of slippage during exposure.

The anti-slip material is applied as a solution or dispersion to the support film and may be applied as a separate coating or added to one of the coating compositions used to coat the film. Conveniently the anti-slip material may be incorporated in the composition from which the diazonium compound is applied. When the composition from which the diazonium compound is applied contains a resinous binder and the anti-slip material, the resinous binder and anti-slip material should represent up to 30% by weight of the solid ingredients of the composition.

An amount of 0.3 to 10.0% by weight of the antislip material must be included in the solution or dispersion from which it is applied to secure adequate resistance to slippage. It is preferred to use a dry coat weight of the anti-slip material in the range 1.0 to 15.0 mg/dm$^2$. For instance, the anti-slip material may be applied from a solution or dispersion of which the anti-slip material does not exceed 2% by weight, thereby resulting in a dry coat weight of the anti-slip material not exceeding 6 mg/dm$^2$. Application of the anti-slip material in an amount in the range 0.3 to 10.0% by weight results in a dry coat weight of the material in the range 0.75 to 25.0 mg/dm$^2$ of the film surface. The amount used may exceed 0.5% by weight but preferably does not exceed 5% by weight of the applied solution or dispersion.

The various coating compositions and layers applied to the film support by the process of this invention may be applied by any coating techniques known in the art such as slot coating or any suitable form of roller coating.

The general arrangement of coating layers in diazotype assemblies which may be made by the process according to this invention is now briefly described with reference to the accompanying schematic drawing, the various figures of which are cross-sections of the support film and the coating layers applied thereto for each embodiment.

In one embodiment of the invention, which is illustrated in FIG. 1 of the drawing, a support film 1 is an impermeable film such as a biaxially oriented and heat set polyethylene terephthalate film. The surface 2 of the support film may have been primed if desired, e.g. in the case of a polyethylene terephthalate film by treatment with a halogenated phenolic material. An anchor layer 3, such as a copolymer of vinyl chloride and vinyl acetate, is applied to the film surface. A further layer 4 applied over the anchor layer contains the diazonium compound and, as desired, other ingredients such as couplers, stabilisers and fillers, and a resinous binder such as cellulose acetate, cellulose acetate propionate, cellulose acetate butyrate or a polyvinylacetal. The diazonium compound-containing layer also contains the anti-slip material which may have been applied as an ingredient of the coating composition from which the layer is derived.

In a modification of the above embodiment an intermediate subbing layer is provided between the anchoring layer and the diazonium compound-containing layer.

Figure 2:
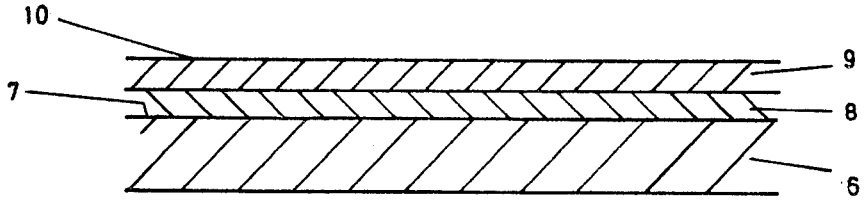

In a second embodiment, which is illustrated in FIG. 2 of the drawing, the assembly consists of an impermeable film 6, which may optionally have been primed on the surface 7, and an anchor layer 8, as in the first embodiment. In this embodiment the anchor layer 8 is coated with a receptive layer 9 which includes an impregnatable plastics material such as cellulose acetate, cellulose acetate butyrate or a polyvinylacetal. The receptive layer is impregnated on its surface 10 by a separate coating treatment with a composition containing a light sensitive diazonium compound, any other ingredients such as couplers, stabilisers and fillers, and the anti-slip material.

Figure 3:
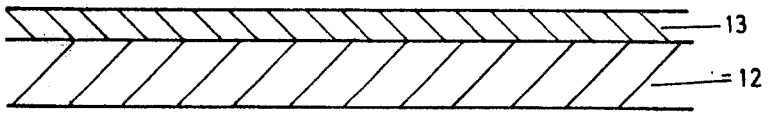

A third embodiment, which is illustrated in FIG. 3 of the drawing, employs a permeable film support 12 such as a cellulose acetate film which is directly coated with a sensitising layer 13 containing a diazonium compound, any other ingredients such as couplers, stabilisers and fillers, and the anti-slip material.

Figure 4:
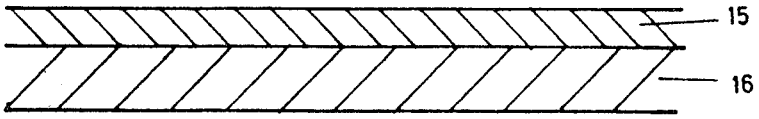

In a fourth embodiment, which is illustrated in FIG. 4 of the drawing, a diazonium compound-containing layer 15 is applied direct to a support film 16, which may be a biaxially oriented and heat set film of polyethylene terephthalate (optionally primed) or a cellulose acetate film. The coating layer 15 includes a resinous binder such as cellulose acetate, cellulose acetate propionate, cellulose acetate butyrate or a polyvinylacetal, the anti-slip material and, as desired, other ingredients such as couplers, stabilisers and fillers.

The above embodiments may be modified by omitting the anti-slip material from the layers in which it has been included and applying it in a separate treatment. The anti-slip material may be applied to the assembly at any stage during its production. For instance it may be applied to the surface of the receptive layer as desired or to the top surface of the sensitised assembly after the application of the composition containing the diazonium compound.

The diazotype materials produced according to this invention may be printed in high speed diazotype printing machines, which operate at linear speeds generally in excess of 100 feet per minute, without slippage, to produce good sharp images.

The invention is illustrated by the following examples of the invention and comparative examples.

COMPARATIVE EXAMPLE A

A 50 micron thick polyethylene terephthalate support film provided with an 8 micron thick layer of cellulose acetate propionate was coated by a conventional meniscus coating technique with the following solution:

| | |
|---|---|
| Methanol | 15 ml |
| Acetone | 85 ml |
| Sulphosalicyclic acid | 1.0 g |
| 2,2',4,4'-tetrahydroxydiphenyl sulphide | 0.7 g |
| 2-hydroxy-2'-methyl-3-naphthanilide | 1.5 g |
| Thiourea | 0.5 g |
| 2,5-dibutoxy-4-N-morpholinobenzene diazonium borofluoride | 3.0 g |

The resulting diazotype microfilm exhibited severe multiple imaging when printed at high speed on a rotating drum contact copier. When viewed under a microscope by reflection at 1000 × magnification the surface of the assembly was seen to be smooth.

EXAMPLE 1

The procedure of Comparative Example A was repeated using the same materials but with the addition of 2.0 g of polymethyl methacrylate which is available commercially under the trade name 'Diakon' MG101 as an anti-slip material to the diazonium salt containing coating solution.

The resulting diazotype microfilm exhibited no multiple imaging when printed on a rotating drum contact copier under the same conditions as used for Comparative Example A. Microscopic examination indicated that the assembly had an uneven or reticulated surface.

COMPARATIVE EXAMPLE B

The following solution was coated by a conventional meniscus coating technique on to a 125 micron thick film of cellulose diacetate:

| | |
|---|---|
| Methanol | 15 ml |
| Acetone | 85 ml |
| Sulphosalicyclic acid | 1.0 g |
| 2,2',4,4'-tetrahydroxydiphenyl sulphide | 0.7 g |
| 2-hydroxy-2'-methyl-3-naphthanilide | 1.5 g |
| Thiourea | 0.5 g |
| 2,5-dibutoxy-4-N-morpholinobenzene diazonium borofluoride | 3.0 g |
| Low molecular weight cellulose diacetate | 0.5 g |

The resulting diazotype microfilm exhibited severe multiple imaging when printed on a rotating drum contact copier and was seen to have a very smooth surface when viewed under a microscope.

EXAMPLE 2

The procedure of Comparative Example B was repeated using the same materials but 2.0 g of polymethyl methacrylate, which is available commercially under the trade name 'Diakon' MG101 were added as an anti-slip material to the diazonium salt containing coating solution.

The resulting diazotype microfilm exhibited no multiple imaging when printed on a rotating drum contact copier under the same conditions used for Comparative Example B. Microscopic examination showed that the assembly had an uneven or reticulated surface.

The assemblies made in the above Examples and Comparative Examples were examined for multiple imaging as follows:

Conventional rotating drum contact copiers conduct the master copy and diazotype copying material in register around a printing drum. Contact between the two films is maintained by the tension of the master copy which is controlled by the torques applied to brake and clutch rollers between which the film passes. The torque applied to the brake and clutch rollers is commonly of the order of 6.0 and 4.0 inch lbs respectively. At these settings severe multiple imaging is shown when using conventional diazotype microfilms printed at high speeds. Increasing the setting of the clutch roller (typically to 5.0 inch lbs) normally reduces multiple imaging, but the tension in the master film around the drum is such that difficulty with breaking of the film may occur.

Use of the diazotype microfilms coated according to the present invention enables copies showing no evidence of multiple imaging to be prepared at normal brake and clutch torque settings of 6.0 and 4.0 inch lbs respectively. In fact the tension of the master film can be reduced to levels which would not be considered suitable for conventional film without inducing multiple imaging in the copy. The range of brake/clutch settings over which no multiple imaging is shown can be taken to be a measure of the efficiency of the compositions of the present invention in preventing multiple imaging. Conventional materials and those according to the invention are compared in Table 1.

TABLE 1

| Film Sample | Brake/Clutch settings (inch lbs) 5/5 | 4/5 | 6/5 | 5/6 |
|---|---|---|---|---|
| Conventional polyester Based diazotype Microfilm - Comparative Example A | M.I. | N.M.I. | M.I. | N.M.I. |
| Modified polyester Based diazotype Microfilm - Example 1 | N.M.I. | N.M.I. | N.M.I. | N.M.I. |
| Conventional cellulose acetate Based diazotype Microfilm - Comparative Example B | M.I. | N.M.I. | N.M.I. | N.M.I. |
| Modified cellulose acetate Based diazotype Microfilm - Example 2 | N.M.I. | N.M.I. | N.M.I. | N.M.I. |

Key:
M.I. = Multiple Images
N.M.I. = No Mutiple Images

EXAMPLE 3

The procedure of Comparative Example A was repeated using the same materials but with the addition of a mixture of 1.5 g of polymethyl methacrylate (available commercially as 'Diakon' MG101) and 0.5 g of polyethyl methacrylate (available commercially as "Paraloid" B72) as an anti-slip material to the diazonium salt containing coating solution.

The diazotype microfilm so produced did not exhibit multiple imaging when printed on a rotating drum contact copier under the conditions specified in Comparative Example A. The surface of the assembly was uneven and reticulated.

EXAMPLE 4

The procedure of Comparative Example A was repeated using the following sensitising solution:

| | |
|---|---|
| Methanol | 15 ml |
| Acetone | 85 ml |
| Sulphosalicyclic acid | 1.0 g |
| 2,5-di-n-butoxy-4-N-morpholino-benzene diazonium fluoborate | 3.0 g |
| Polymethyl methacylate (available commercially under the trade name 'Diakon' MG101) | 2.0 g |

The resulting diazotype microfilm was printed at high speed on a rotating drum contact copier, and the latent image developed by immersion in the following solution, which was maintained at a temperature of 20° C.:

| | |
|---|---|
| Ethyl alcohol | 500 ml |
| Water | 500 ml |
| Butyl acetate | 10.0 g |
| Butyl formate | 10.0 g |
| Ammonia (specific gravity 0.91) | 2.0 g |
| Phloroglucinol | 1.0 g |

The resulting developed microfilm exhibited no multiple images, whereas a similar film prepared without the use of the polymethyl methacrylate component in the sensitising solution exhibited severe multiple images.

EXAMPLE 5

The procedure of Comparative Example A was repeated using the same materials but with the addition of 2.0 g of polymethyl acrylate as an anti-slip material to the diazonium salt containing coating solution.

The resulting diazotype microfilm exhibited no multiple imaging when printed on a rotating drum contact copier under the same conditions as used for Comparative Example A.

EXAMPLE 6

The procedure of Comparative Example A was repeated using the same materials but with the addition of 2.0 g polyethyl acrylate as an anti-slip material to the diazonium salt containing coating solution.

Similar results were obtained to those shown by the diazotype microfilm of Example 5.

EXAMPLE 7

The procedure given in Comparative Example A was repeated using the same materials but with the addition of 2.0 of polybutyl methacrylate as an anti-slip material in the diazonium salt containing coating solution.

Similar results were obtained to those shown in the diazotype microfilm of Example 5.

EXAMPLE 8

The procedure of Comparative Example A was repeated with the addition of 2.0 g of a copolymer of butyl methacrylate and methyl methacrylate (molar ratio 2:1 respectively) as an anti-slip material to the diazonium salt containing coating solution.

Similar results were obtained to those shown by the diazotype microfilm of Example 5.

In modifications of Examples 5 to 8, cellulose diacetate support films may be treated as described in Comparative Example B but with the addition of the anti-slip materials specified in Examples 5 to 8 to the diazonium salt containing solution, the results being similar to those described in Examples 5 to 8.

COMPARATIVE EXAMPLE C

A 50 micron thick polyethylene terephthalate support film provided with an 8 micron thick layer of cellulose acetate propionate was coated by a conventional meniscus coating technique with the following solution:

| | |
|---|---|
| Methanol | 10 ml |
| Acetone | 85 ml |
| 2-ethoxyethanol | 5 ml |
| Toluene-p-sulphonic acid | 1.9 g |
| 2-hydroxy-2-'-methyl-3-naphthanilide | 1.3 g |
| 3-hydroxy-acetoacetanilide | 0.8 g |
| 2,5-diethoxy-4-N-morpholino-benzene diazonium fluoborate | 2.8 g |

The resulting diazotype microfilm exhibited severe multiple imaging when printed at high speed on a rotating drum contact copier.

EXAMPLES 9 TO 11 AND COMPARATIVE EXAMPLE D

The diazotype microfilm of Comparative Example C was further coated by a conventional meniscus coating technique with various concentrations of polymethyl methacrylate (available commercially under the trade name 'Diakon' MG101) dissolved in a solvent mixture of 85 parts acetone and 15 parts methanol.

The resulting diazotype microfilms when printed on a rotating drum contact copier at high speed, showed images having appearances as given in Table 2, which also includes the results of Comparative Example C.

TABLE 2

| Example | Grams polymethyl methacrylate in 100 mls solvent | Coat weight polymethyl methacrylate ($mg/dm^2$) | Image appearance |
|---|---|---|---|
| Comparative C | 0.0 | 0.0 | Severe multiple imaging |
| Comparative D | 0.1 | 0.6 | Slight multiple imaging |
| 9 | 1.0 | 6.0 | No multiple imaging |
| 10 | 2.0 | 12.0 | No multiple imaging |
| 11 | 4.0 | 24.0 | No multiple imaging |

The coat weight of polymethyl methacrylate used in Comparative Example D was inadequate to prevent multiple imaging.

We claim:

1. A light sensitive diazotype material suitable for use in high speed copying machines which comprises a plastic support film coated with a layer which includes a light sensitive diazonium compound and also (a) a resinous binder applied directly to the surface of the support film or to an underlying subbing layer, or (b) a receptive plastics material impregnated with said diazonium compound, wherein an anti-slip material comprising a homopolymer or copolymer of acrylic acid or methacrylic acid or a lower alkyl ester of acrylic acid or methacrylic acid in which the alkyl group contains up to 8 carbon atoms as an anti-slip material is either incorporated in said layer which includes said diazonium compound or applied thereto to produce a surface roughness, said homopolymer or copolymer being present in an amount of 0.75 to 25 mg/dm$^2$ of the film surface.

2. A diazotype material according to claim 1 wherein said surface roughness is sufficient to mimimize slippage when said diazotype material and a master are in intimate contact around the periphery of a rotating drum, glass cylinder, or through a vacuum head, during exposure to ultraviolet light.

3. A diazotype material according to claim 1, in which, when the diazonium compound-containing layer includes a resinous binder, said binder is selected from the group consisting of cellulose acetate, cellulose acetate propionate, cellulose acetate butyrate, polyvinylacetal, polyvinyl acetate or partially hydrolysed polyvinyl acetate.

4. A diazotype material according to claim 1, in which the support film is a cellulose acetate film or biaxially oriented and heat set film of polyethylene terephthalate.

5. A diazotype material according to claim 1, in which the support film is a film of polyethylene terephthalate which has been surface treated with a halogenated phenolic material of a halogenated fatty acid.

6. A diazotype material according to claim 1, in which the anti-slip material is present in an amount in the range 1.0 to 15.0 mg/dm$_2$.

7. A diazotype material according to claim 1, in which the anti-slip material comprises polymethyl methacrylate, polyethyl methacrylate and/or polybutyl methacrylate.

* * * * *